United States Patent [19]

Takahashi et al.

[11] Patent Number: 4,619,519

[45] Date of Patent: Oct. 28, 1986

[54] ELECTROPHOTOGRAPHIC CAMERA PROCESSOR-READER

[75] Inventors: Michihiko Takahashi; Eiichi Saito, both of Tokyo; Takeshi Okano; Sadaaki Nakaoka, both of Nishinomiya, all of Japan

[73] Assignee: Fuji Photo Film Co., Ltd., Kanagawa, Japan

[21] Appl. No.: 632,222

[22] Filed: Jul. 19, 1984

[51] Int. Cl.[4] ..... G03G 15/00

[52] U.S. Cl. ..... 355/11; 355/5; 355/44; 355/21; 355/64

[58] Field of Search ..... 355/5, 11, 21, 44, 64; 350/508

[56] References Cited

U.S. PATENT DOCUMENTS 3,697,176 10/1972 Kuehnle et al. ..... 355/45
3,781,106 12/1973 Lysle ..... 355/9
3,972,610 8/1976 Gross ..... 355/95
4,286,864 9/1981 Lysle et al. ..... 355/5

*Primary Examiner*—Arthur T. Grimley
*Assistant Examiner*—David Warren

[57] ABSTRACT

An electrophotographic camera processor-reader in which the function of recording of picture image data on an electrophotographic film and the function of enlargement projection of picture image data recorded on the electrophotographic film can be changed over as required. One lens having both the function of focusing picture image data carried by an original onto the electrophotographic film, and the function of projecting picture image data recorded on the electrophotographic film onto an opaque screen is provided in combination with a combined screen and original-supporting plate, so as to simplify the structure of and reduce the size of the apparatus.

5 Claims, 6 Drawing Figures

ELECTROPHOTOGRAPHIC CAMERA PROCESSOR-READER

TECHNICAL FIELD OF THE INVENTION

This invention relates to an electrophotographic camera processor-reader capable of enlargement and projection of picture image data recorded on an electrophotographic film and capable of recording such data on the electrophotographic film as desired, and more particularly to an apparatus of the kind above described which can be manufactured at low cost and is small in overall size.

TECHNICAL BACKGROUND OF THE INVENTION

A microfilm is used as one means for storing records of many documents, prints, etc. The microfilm carries these records in a greatly reduced scale, so that the various picture image data recorded on the microfilm can be reenlarged to be projected on a screen or reenlarged to be copied by a copying apparatus when so required.

A conventional microfilm in the form of a silver-halide photosensitive member is defective in that, unlike a magnetic tape once picture image data are recorded thereon, other required picture image data cannot be additionally recorded theron or the picture image data already recorded thereon cannot be modified or corrected.

A microfilm in the form of an electrophotosensitive member permitting addition and modification or correction of recorded picture image data has been developed to obviate the defect of the conventional microfilm. This electrophotographic microfilm is formed by laminating a layer of a transparent conductive material and a layer of a transparent photoconductive insulating material on a base of a transparent insulating material. The electrophotographic microfilm has the feature of exhibiting photosensitivity when electrostatically charged. Another feature of the electrophotographic microfilm is that it requires a short length of time and a narrow space for developing. Such an electrophotographic film having the features above described, therefore, after recording a plurality of picture image data of different themes in spaced-apart relation on the electrophotographic microfilm, relevant picture image data can be additionally recorded adjacent to the record picture image data as required.

Recording of picture image data on such an electrophotographic microfilm requires electrophotographic processing means for performing the various steps of processing including electrostatic charging, exposure, developing and fixing of picture image data to be recorded on the electrophotographic microfilm. Also, reading of picture image data recorded on the electrophotographic microfilm requires means for enlarging and projecting the picture image data recorded on the electrophotographic microfilm. For this purpose, an electrophotographic camera processor-reader has been developed which is provided with both the electrophotographic processing means and the enlarging-projecting means described above.

FIG. 1 shows schematically the structure of one form of a prior art electrophotographic camera processor-reader. Referring to FIG.1, an electrophotographic microfilm 101 in web or belt form is wound at both ends thereof around a pair of winding shafts 102 respectively, and these winding shafts 102 are supported so as to rotate in both normal or reverse directions relative to a housing 103. An original-supporting glass plate 105, on which an original 104 is placed with its front side facing downward, is disposed onthe upper part of the housing 103, and a light source or lamp 106 illuminating the original 104 is disposed beneath the original-supporting glass plate 105.

Along the electrophotographic micrograph 101 extending between the pair of winding shafts 102, a charger 107, a recording lens 108, a developer 109, and a fixing and projecting lamp 110 are disposed in the above order. The charger 107 acts to electrostatically charge the electrphotographic microfilm 101 to render the charged area photosensitive, and the recording lens 108 acts to focus picture image data carried by the original 104 onto the charged area of the electrophotographic microfilm 101. The developer 109 acts to toner-develop an electrostatic latent image of the picture image data formed on the electrophotographic microfilm 101, and the lamp 110 has the function of heat-fixing the toner image of the picture image data formed by the developer 109 on the electrophotographic microfilm 101 and functions also as an illumination light source for projection of an enlarged toner image with transmitted light. For this purpose, a heat-shielding filter111is movably interposed between the electrophotographic microfilm 101 and the lamp 110 so that it can be brought to a non-heat-shielding position during the step of fixing and to a heat-shielding position during the step of projection. A projection lens 112 is disposed opposite the illuminating lamp 110 on the other side of the electrophotographic microfilm 101, so that the toner image formed on the electrophotographic microfilm 101 can be projected through three reflecting mirrors 113 onto a translucentscreen 114 as an enlarged image.

The prior art electrophotographic camera processor-reader having such a construction is defective in that the overall apparatus tends to become large in size and quite expensive because of the fact that the optical systems for picture image data recording and projecting purposes are provided independently of each other.

On the other hand, U.S. Pat. Nos. 4,286,864 and 3,697,176 disclose an apparatus having both the function of a camera processor and the function of a reader. Both of these U.S. patents have, however, been defective in that the necessity for the provision of a movable mirror for changing over the optical path results inevitably in a bulky overall apparatus, because a projection screen and an original-supporting glass plate are disposed at separate positions in each of them. In U.S. Pat. No. 3,781,106 in which an original-supporting plate acts also as a projection screen, the arrangement is such that light emitted from a projection light source and reflected from a recorded film is projected onto the screen. Thus, when the idea disclosed in this U.S. Pat. No. 3,781,106 is applied to an electrophotographic apparatus using a transparent electrophotographic film, the light reflected from a recorded film is projected onto a screen through an optical system including a lens, a reflecting mirror and the like. Such an apparatus requires a lamp emitting light of high luminous intensity compared with an apparatus of the type in which light transmitted through a film is projected onto a screen. Such an apparatus is therefore disadvantageous from the aspects of cost and space. Also, U.S. Pat. No. 3,781,106 does not disclose any arrangement permitting utilization of transmitted light in view of the relation between the light source and other members but merely resorts to utilization of reflected light. Further, none of the three U.S. patents cited above moves a fixed mirror in a non-operating state of the apparatus, thereby making the overall apparatus more compact and less bulky.

SUMMARY OF THE INVENTION

It is a primary object of the present invention to provide an electrophotographic camera processor-reader which includes an optical system which focuses picture image data carried by an original onto an electrophotographic film and also projects picture image data recorded on the electrophotographic film onto a projection screen in which projection by transmitted light is also employed, so as to simplify the structure of and reduce the size of the apparatus.

In accordance with the present invention which attains the above object, there is provided an electrophotographic camera processor-reader with a housing into which an electrophotographic film may be removably loaded, and an electrophotographic process head fixedly disposed in the housing and including a charging section, an exposure section, a developing section and a fixing section for sequentially performing a series of processing steps on the electrophotographic film. The processor-reader also has a combined screen and original-supporting plate fixedly disposed in the housing for functioning as an opaque screen onto which enlarged picture image data recorded on the electrophotographic film are projected and functioning also as an original-supporting plate. A recording-projecting lens is positioned in the housing at a position opposite the exposure section of the electrophotographic process head, the processing head being interposed between the recording-projecting lens and the electrophotographic film. The recording-projecting lens focusses picture image data carried by an original placed on the combined screen and original-supporting plate onto the electrophotographic film as well as projects picture image data recorded on the electrophotographic film onto the combined screen and original-supporting plate. Furthermore, there is a light source for transmitted illumination for projecting the picture image data recorded on the electrophotographic film onto the combined screen and original-supporting plate with transmitted light.

BRIEF DESCRIPTION OF THE DRAWINGS

As mentioned above.

DETAILED DESCRIPTION OF THE PREFERRED EMBODIMENTS

A preferred embodiment of the electrophotographic camera processor-reader according to the present invention will be described in detail with reference to FIGS. 2, 3(A), 3(B), 4 and 5.

Figure 1:
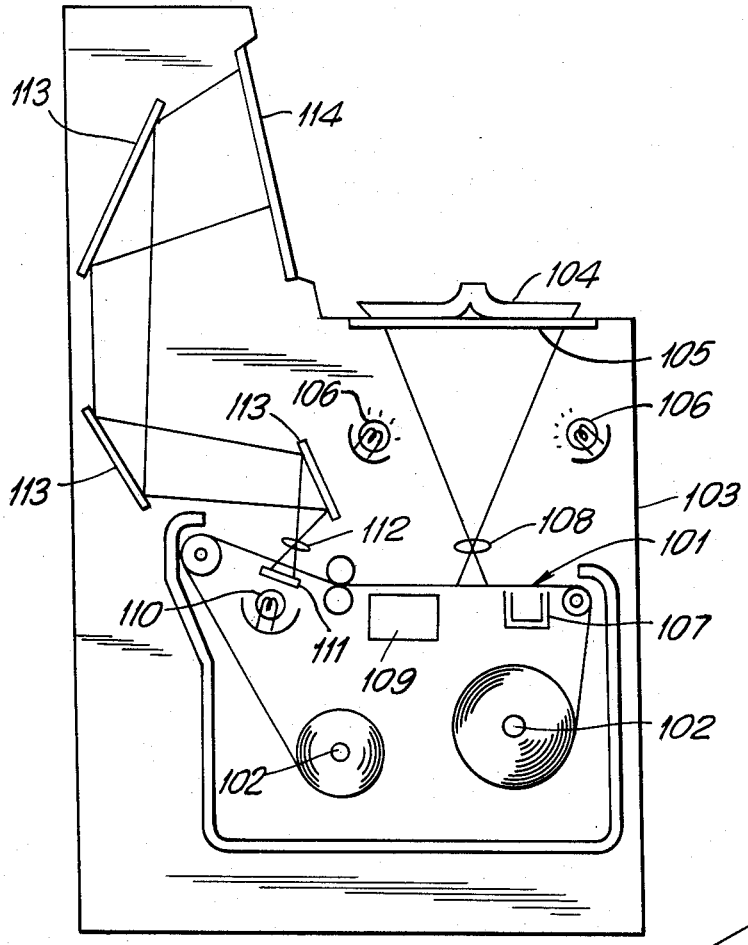
(PRIOR ART) FIG. 1
FIG. 1 is a diagrammatic view showing schematically the structure of an electrophotographic camera processor-reader used hitherto and commonly known in the art.
Figure 2:
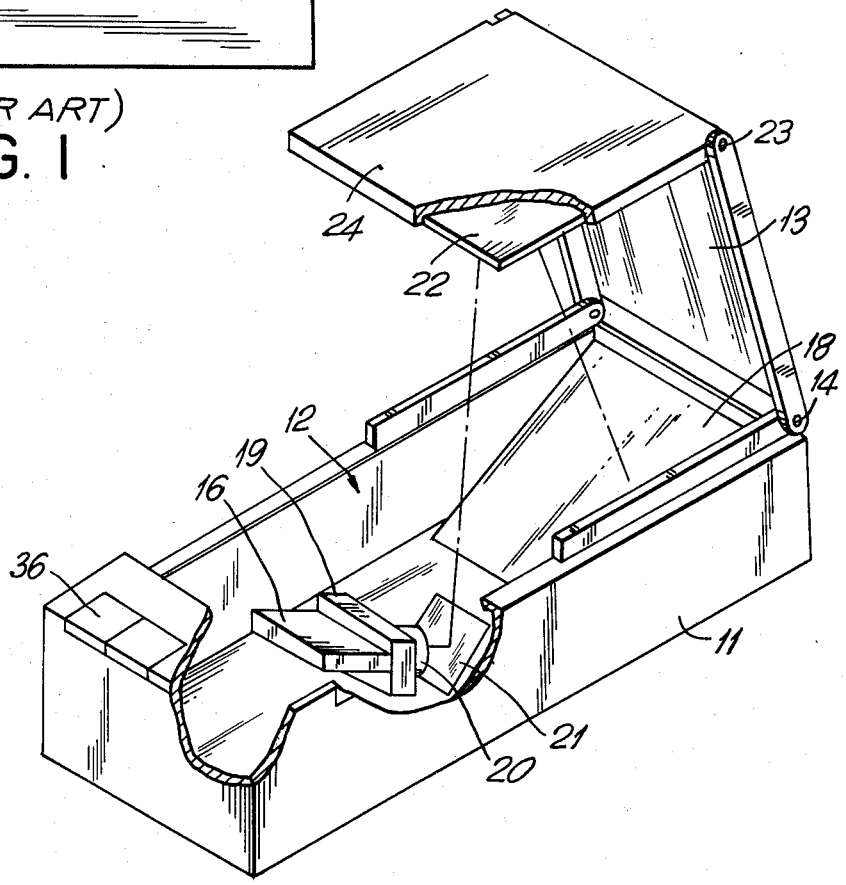
FIG. 2 is a partly cutaway perspective view showing the structure of a preferred embodiment of the electrophotographic camera processor-reader according to the present invention.
Figure 3A:
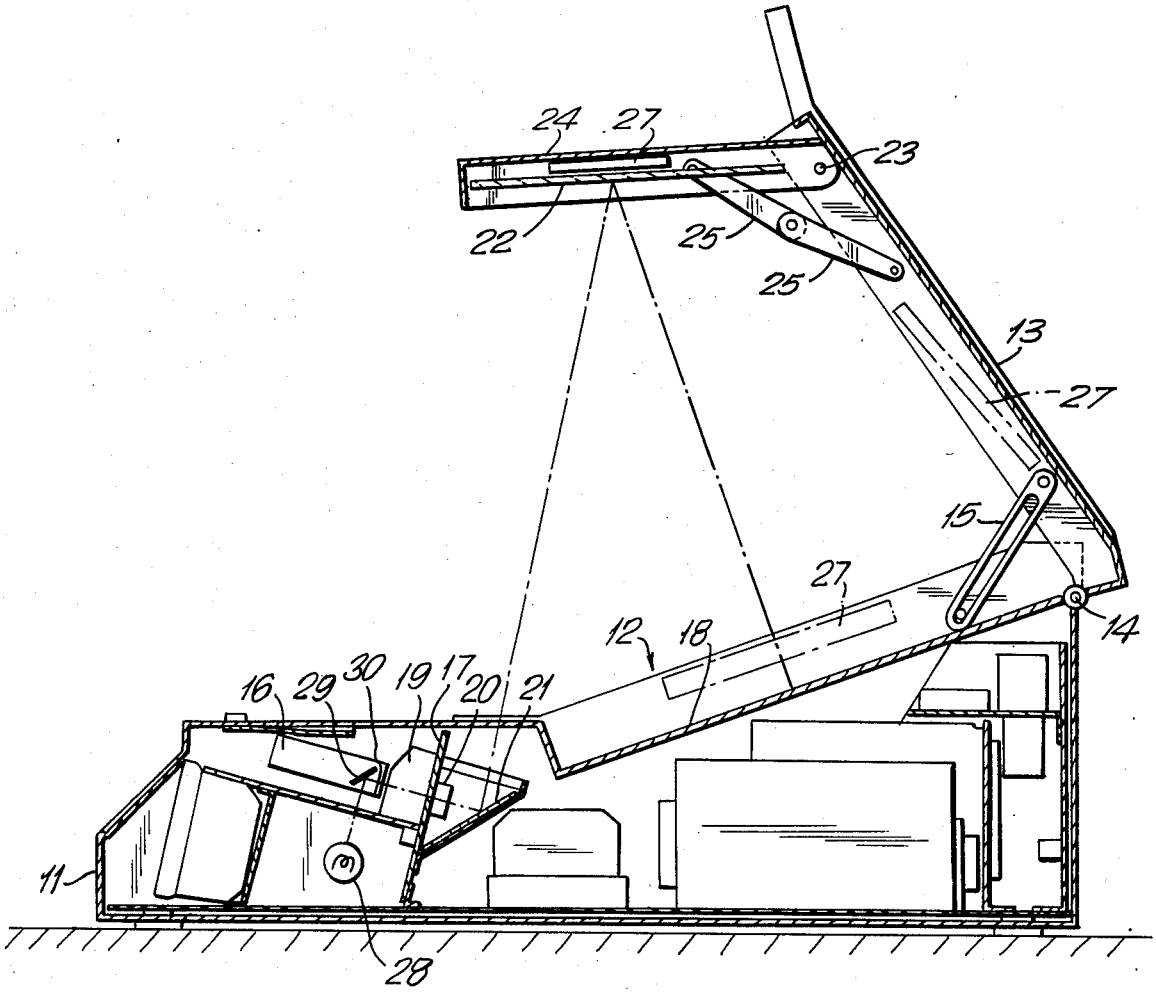
FIGS. 3(A) and 3(B) are diagrammatic, sectional side elevation views showing two modes of the electrophotographic camera processor-reader of the present invention in use.
Figure 3B:
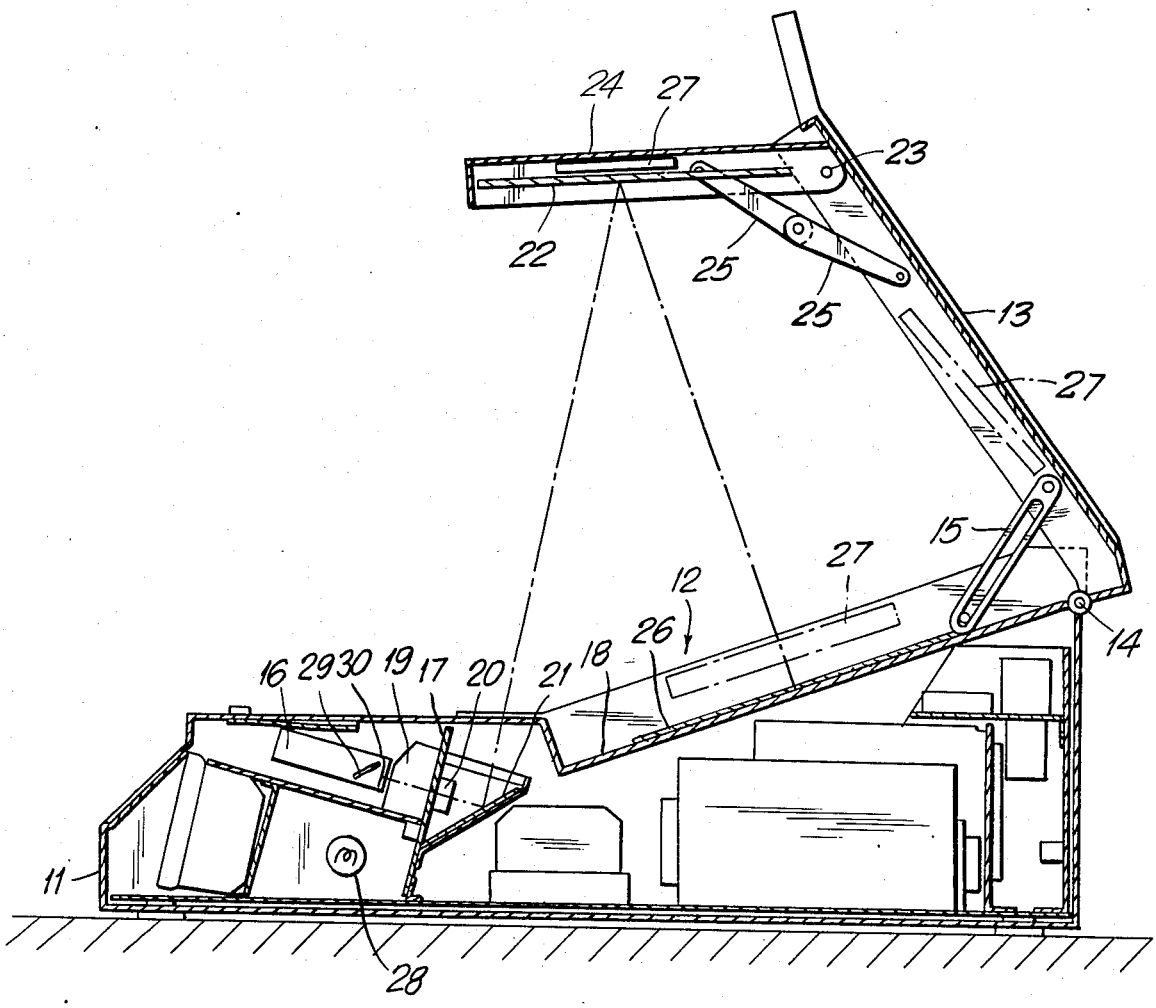

Referring first to FIGS. 2, 3(A) and 3(B), the electrophotographic camera processor-reader embodying the present invention includes a housing 11 in the form of a rectangular box. An openable cover member 13 which normally closes an opening 12 of the housing 11 is pivoted on one end of the housing 11 by pivot pins 14. An auxiliary stay 15 is pivoted at one end thereof to the cover member 13 and at the other end thereof to the housing 11 to limit the range of the rocking movement of the cover member 13 relative to the housing 11. The cover member 13 can be locked relative to the housing 11 by a click stop mechanism (not shown) associated with the free end thereof when it is moved to its open position. A cassette 16 containing an electrophotographic film 30 therein is removably loaded into the housing 11 from the top side of the housing 11 in which a bracket 17 is fixed. An electrophotographic process head 19 includes a charging section for electrostatically charging the electrophotographic film 30, an exposure section for exposing picture image data carried by an original 26 placed on a combined screen and original-supporting plate 18 described later, a developing section for toner-developing an electrostatic latent image formed on the electrophotographic film 30 as a result of exposure, and a fixing section for fixing the toner-developed electrostatic latent image onto the electrophotographic film 30. The electrophotographic process head 19 having the charging section, exposure section, developing section and fixing section arranged in the above order is mounted in a fixed position slanting downward in relation to the bracket 17, and a recording-projecting lens 20 is positioned in the housing 11 at a position opposite the exposure section of the electrophotographic process head 19 with the electrophotographic film 30 interposed therebetween and is mounted in a fixed position on the bracket 17.

The combined screen and original-supporting plate 18 is mounted in a fixed position in the opening 12 of the housing 11 nearer the end to which the cover member 13 is pivoted, and extends to slant upward in contrast to the attitude of the electrophotographic process head 19. This combined screen and original-supporting plate 18 functions as an original-supporting plate, on which an original 26 is placed facing upward and functions also as an opaque screen onto which the toner image formed on the electrophotographic film 30 is projected after being enlarged by the recording-projecting lens 20. This recording-projecting lens 20 functions not only as a recording lens for focusing picture image data carried by the original 26 placed on the combined screen and original-supporting plate 18 onto the electrophotographic film 30 brought to the position opposite the exposure section of the electrophotographic process head 19 but also functions as a projecting lens for enlarging and projecting the toner image formed on the electrophotographic film 30 brought to the position opposite the exposure section on the combined screen and original-supporting plate 18.

A first reflecting mirror 21 is disposed in front of the recording-projecting lens 20 slanting upward relative to the recording-projecting lens 20. A second reflecting mirror 22 cooperating with the first reflecting mirror 21 to establish an optical path between the recording-projecting lens 20 and the combined screen and original-supporting plate 18 is fixedly mounted on a mirror holder 24 pivoted by pivot pins 23 to the free end of the cover member 13. A stay 25 that can be doublefolded acts to limit the range of rocking movement of the mirror holder 24 relative to the cover member 13. When brought to the position illustrated in FIGS. 3(A) and 3(B), the mirror holder 24 can be locked relative to the cover member 13 by a click stop mechanism (not shown) associated with the pivoted end of the mirror holder 24, so that the mirror holder 24 can be accurately positioned relative to both of the first reflecting mirror 21 and the combined screen and original-supporting plate 18. The inclination angle of the combined screen and original-supporting plate 18 is preferably determined from the aspect of human engineering so that the picture image data of the electrophotographic film 30 projected onto the combined screen and original-supporting plate 18 can be readily viewed. In the illustrated embodiment, the mirror holder 24 is arranged so as to swing inward from the cover member 13 by the function of the stay 25 to be accommodated in the cover member 13, and the cover member 13 is arranged to close the opening 12 of the housing 11. However, it is also possible that the mirror holder 24 be arranged to rock together with the cover member 13 as a straight extension of the cover member 13, and such a combination of the mirror holder 24 and the cover member 13 closes the opening 12 of the housing 11. In such a case, the mirror holder 24 acts as a part of the cover member 13.

For the purpose of recording the picture image data carried by the original 26 placed on the combined screen and original-supporting plate 18, a lamp 27 for illuminating the original 26 is preferably disposed in the housing 11, in the internal space of the cover member 13 or on the mirror holder 24, since an image having a sharp contrast can be recorded when the original 26 is illuminated. For a similar reason, a lamp 28 for illumination with transmitted light is preferably disposed adjacent to the exposure section of the electrophotographic process head 19 to be used during the projection of picture image data recorded on the electrophotographic film 30.

FIG. 3(A) illustrates the state of the electrophotographic camera processor-reader embodying the present invention in the projection mode. As shown in FIG.3(A), light emitted from the lamp 28 for transmitted illumination and reflected from a projecting-purpose reflecting mirror 29 is transmitted through the electrophotographic film 30 in the cassette 16. Picture image data recorded on the electrophotographic film 30 are enlarged by the recording-projecting lens 20 and reflected by the first reflecting mirror 21 and then by the second reflecting mirror 22 mounted on the mirror holder 24 to be finally projected onto the combined screen and original-supporting plate 18.

FIG. 3(B) illustrates the state of the apparatus in the recording mode. As shown in FIG. 3(B), the original 26 placed on the combined screen and original-supporting plate 18 is illuminated with light emitted from the original-illumination lamp 27 disposed on the side wall of the opening 12 of the housing 11 or in the internal space of the cover member 13 or on the mirror holder 24. Picture image data reflected by the second reflecting mirror 22 and then by the first reflecting mirror 21 are focused by the recording-projecting lens 20 to be recorded on a predetermined image area of the electrophotographic film 30 brought to the position opposite to the exposure section of the electrophotographic process head 19.

The projecting-purpose reflecting mirror 29 used in the projection mode is fixed to the housing 11 in such a relation that the mirror 29 opposes a pre-formed cavity of the cassette 16 when the cassette 16 is loaded in position in the housing 11. Therefore, the weight of the cassette 16 can be reduced to improve the portability.

Figure 4:
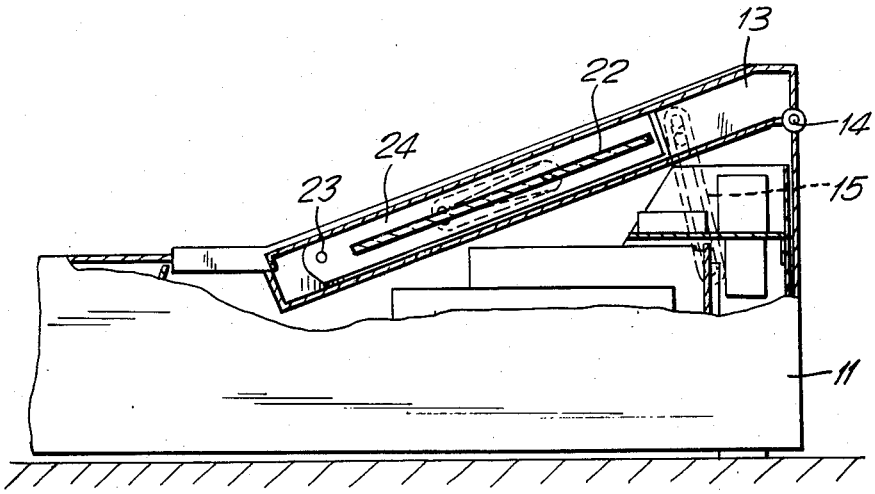
FIG. 4 is a diagrammatic, partly sectional, side elevation view of the electrophotographic camera processor-reader of the present invention when its openable cover member is closed.

When it is desired to carry the overall apparatus by hand or to store it, the cover member 13 is folded toward the housing 11. The resultant overall shape is quite compact because the second reflecting mirror 22 is accommodated in the cover member 13 (FIG. 4).

In the recording mode for recording picture image data on the electrophotographic film 30, charging and exposure can be effected at the same station.

Figure 5:
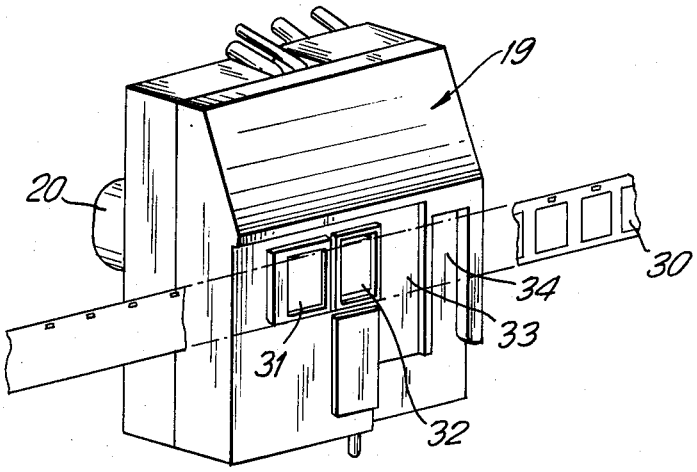
FIG. 5 is a perspective view showing the external appearance of the process head employed in the embodiment of the present invention.

As the electrophotographic process head 19 of such a structure, a head such as, for example, that disclosed in co-pending U.S. patent application Ser. No. 578,522 entitled "Electrophotographic Device" and filed Feb. 9, 1984 can be used. As shown in FIG. 5 showing the external appearance of such an electrophotographic process head 19, a corona wire and a grounded electrode are incorporated in a charging and exposure section 31 to electrostatically charge a predetermined area of the electrophotographic film 30. The recording-projecting lens 20 is disposed opposite to the corona wire to focus picture image data carried by the original 26 onto the electrophotographic film 30 as an electrostatic latent image. In a developing section 32, a liquid toner develops the electrostatic latent image formed on the electrophotographic film 30 into visible image. In a drying section 33, the liquid toner is dried, and, in a fixing section 34, the toner image is heat-fixed by a flash of light.

In the projection mode, an area of the electrophotographic film 30 to be projected is positioned opposite the charging and exposure section 31 of the electrophotographic process head 19, and the recording-projecting lens 20 projects enlarged picture image data onto the combined screen and original-supporting plate 18.

In the illustrated embodiment of the present invention, the combined screen and original-supporting plate 18 is positioned to extend in a slant relation upward. However, the arrangement of the individual members may be suitably modified as desired. For example, the cover member 13 may be mounted on the housing 11 to be openable sidewards, and the combined screen and original-supporting plate 18 may be arranged to extend upright. Although a structure which does not include the cover member 13 and reflecting mirrors 21 and 22 may be employed, such a structure will lead to a bulky apparatus.

When the electrophotographic camera processor-reader is not in use, the cover member 13 is maintained in the position of closing the opening 12 of the housing 11. On the other hand, when the apparatus is to be used, the cover member 13 swings to its open position, and, after swinging the mirror holder 24 to its predetermined position, a cassette 16 containing an electrophotographic film 30 is loaded in the housing 11. In the recording mode, an original 26 is fixed on the combined screen and original-supporting plate 18, and actuating switches 36 (FIG. 2) disposed on the other end of the housing 11 are selectively manipulated to record picture image data carried by the original 26 on a predetermined area of the electrophotographic film 30. In the monitoring mode monitoring the toner image of the picture image data formed on the electrophotographic film 30 as a result of development or in the reproduction mode reproducing the heat-fixed picture image data, the electrophotographic film 30 is moved to the position opposite the charging and developing section 31, and, after removing the original 26 from the combined screen and original-supporting plate 18, the picture image data recorded on the electrophotographic film 30 are enlarged and projected by the recording-projecting lens 20 onto the combined screen and original-supporting plate 18.

It will be understood from the foregoing detailed description that, according to the electrophotographic camera processor-reader of the present invention, one lens can function as both the recording lens and the projecting lens and also one plate can function as both the opaque screen and the original-supporting plate. Therefore, the desired great reduction of the cost and the desired reduction of the size and weight of the apparatus can be achieved simultaneously. Further, by virtue of the image projection with transmitted illumination, a light source of low luminous intensity can be satisfactorily employed for the purpose. Furthermore, since one of the reflecting mirrors is arranged to be accommodated in the cover member, the apparatus can be made more compact in shape than hitherto when not in use.

We claim:

1. An electrophotographic camera processor-reader comprising: a housing for removably receiving an electrophotographic film, an electrophotographic process head fixedly disposed in said housing and including a charging section, an exposure section, a developing section and a fixing section for sequentially performing a series of processing steps on the electrophotographic film, a combined screen and original-supporting plate fixedly disposed in said housing for functioning as an opaque screen onto which enlarged picture image data recorded on the electrophotographic film are projected and functioning also as an original-supporting plate, a recording-projecting lens positioned in said housing at a position opposite the exposure section of said electrophotographic process head, said process head being interposed between the recording-projecting lens and the electrophotographic film, said recording-projecting lens functioning to focus picture image data carried by an original placed on said combined screen and original-supporting plate onto the electrophotographic film and functioning also to project picture image data recorded on the electrographic film onto said combined screen and original-supporting plate, and a light source arranged for projecting the picture image data recorded on said electrophotographic film onto said combined screen and original-supporting plate with light transmitted through said film.

2. An electrophotographic camera processor-reader as claimed in claim 1, further comprising a first reflecting mirror fixedly mounted in said housing to slant in front of said recording-projecting lens, and a second reflecting mirror coupled to said housing and cooperating with said first reflecting mirror to establish an optical path between said combined screen and original-supporting plate and said recording-projecting lens.

3. An electrophotographic camera processor-reader as claimed in claim 2, further comprising an openable cover member pivoted at one end thereof to one end of said housing for normally closing an opening formed in said housing, said second reflecting mirror being mounted in a portion of said cover member to cooperate with said first reflecting mirror to establish said optical path between said combined screen and original-supporting plate and said recording-projecting lens when said cover member is swung to its open position.

4. An electrophotographic camera processor-reader as claimed in claim 3, wherein said second reflecting mirror is fixed to a mirror holder pivoted to the other end of said cover member.

5. An electrophotographic camera processor-reader as claimed in claim 4, wherein said mirror holder is foldable to be accommodated in the internal space of said cover member when said camera processor-reader is not in use.

* * * * *